US005097606A

United States Patent [19]

Harmelink et al.

[11] Patent Number: 5,097,606

[45] Date of Patent: Mar. 24, 1992

[54] LINT FILTER SIGNAL FOR AUTOMATIC CLOTHES DRYER

[75] Inventors: Gregory K. Harmelink, Newton; Pamela M. Kuecker, Prairie City; Michael D. Lafrenz; J. Christopher Millet, both of Newton, all of Iowa

[73] Assignee: Maytag Corporation, Newton, Iowa

[21] Appl. No.: 571,157

[22] Filed: Aug. 23, 1990

[51] Int. Cl.[5] ..... F26B 3/00; F26B 19/44

[52] U.S. Cl. ..... 34/32; 34/82; 34/87; 34/88

[58] Field of Search ..... 34/43, 48, 87, 82, 88, 34/32, 89

[56] References Cited

U.S. PATENT DOCUMENTS

| | | | |
|---|---|---|---|
| 2,776,826 | 1/1957 | Bennett et al. | 34/87 X |
| 2,941,308 | 6/1960 | Cobb et al. | 34/48 |
| 3,286,508 | 11/1966 | Spiegel | 73/38 |
| 3,484,772 | 12/1969 | Niewyk et al. | 340/236 |
| 4,206,552 | 6/1980 | Pomerantz et al. | 34/43 X |
| 4,763,425 | 8/1988 | Grennan | 34/48 |

*Primary Examiner*—Henry A. Bennet
*Attorney, Agent, or Firm*—Richard L. Ward

[57] ABSTRACT

A microprocessor controlled clothes dryer wherein the posture of a switch in the lint filter system is monitored and a signal to CHECK FILTER is displayed if the switch posture has not changed. The switched is a reed switch mounted stationary on the lint filter assembly and a magnet operator is attached to the removable filter screen. Movement of the filter screen into and out of filtering position in the lint filter assembly of the exhaust duct changes the posture of the magnet operated reed switch. Change of posture of the switch through its cycle impresses a change of voltage on the microprocessor. The microprocessor effects control over the CHECK FILTER signal that is visually illuminated on a VFD tube; such that, if the microprocessor sees the cycling of the switch the CHECK FILTER signal is extinguished.

17 Claims, 10 Drawing Sheets

LINT FILTER SIGNAL FOR AUTOMATIC CLOTHES DRYER

BACKGROUND OF THE INVENTION

This invention relates to the field of automatic clothes dryers. In particular, it relates to the lint filter system and a signal for indicating that the lint filter needs to be checked for lint build-up.

The automatic clothes dryer employs a lint filter. The heated drying air from the clothes dryer passes through the tumbling chamber or rotating drum containing the clothes to be dried. This spent drying air, after leaving the chamber, passes through the lint filter which traps and holds any lint or solid particles suspended in the exhausted air. After periods of drying use, usually one or more drying cycles, the lint filter accumulates a coating of trapped lint and if not cleaned, the lint filter may become clogged. This becomes a resistance to air flow through the dryer which interferes with efficient operation.

There has been devised a number of devices for clothes dryers in the prior art to detect a clogged filter and warn the operator of the condition; or in the alternative, to shut down the heat source of the dryer during its drying cycle if the clogged filter condition is detected. In U.S. Pat. No. 3,286,508, the condition of the filter is determined by sensing variations in the static pressure, or in U.S. Pat. No. 2,941,308, air flow volume through the filter is sensed and if lint buildup is present, the drying unit is shut down and a signal is given. U.S. Pat. No. 3,484,772 senses the condition of the filter by shining a light through it and if the filter is coated with lint to such a degree to diminish the light intensity, a signal is given by a flashing light to alert the operator of the condition. And, U.S. Pat. No. 4,206,552 utilizes a sensor system that measures the temperature of the air entering the drying compartment and compares it with the temperature of the moisture laden air leaving the drying compartment. A control element interprets this information of sensed temperature and if the temperature differential exceeds a value, it indicates a clogged filter and deactivates the drying apparatus. And, in U.S. Pat. No. 4,763,425, the microprocessor control for the dryer includes a reminder which flashes a CLEAN FILTER signal on the control panel when selecting one of the "on/select" touch pads of the operator's control.

The prior art has shown a number of lint filter systems in which a signal of one kind or another is incorporated to alert the operator to a clogged condition of the filter.

SUMMARY OF THE INVENTION

The present invention provides a reminder signal for the operator to CHECK FILTER upon activating a pad of the control panel to perform a new drying cycle, if the lint filter was not checked for lint by removal of the filter since the last drying cycle.

The invention incorporates a signal into a microprocessor controlled clothes dryer wherein the microprocessor monitors the posture of a switch. A message will be displayed to CHECK FILTER if the switch has not cycled between open and closed postures after a predetermined point in a cycle of operations.

In one embodiment, the invention utilizes a magnetically operated reed switch system on the lint filter assembly with the lint filter element of the assembly carrying one of the switch system components. The other component of the switch system is supported in a fixed position on the framework of the lint filter assembly. The open and closed postures of the switch are effected by physically removing the lint filter element from the assembly and replacing the filter. The CHECK FILTER on the control panel display area will occur when a new drying cycle is started if the lint filter has not been removed and checked since the cycle was entered. The microprocessor must see that the "open-close" switch cycle has been accomplished to remove the CHECK FILTER illumination from the display area.

In addition to the display, an audible signal may be provided to alert the operator to remove and check the lint filter for lint accumulation.

The operation of the clothes dryer and further objects and advantages thereof will become apparent from the description and accompanying drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
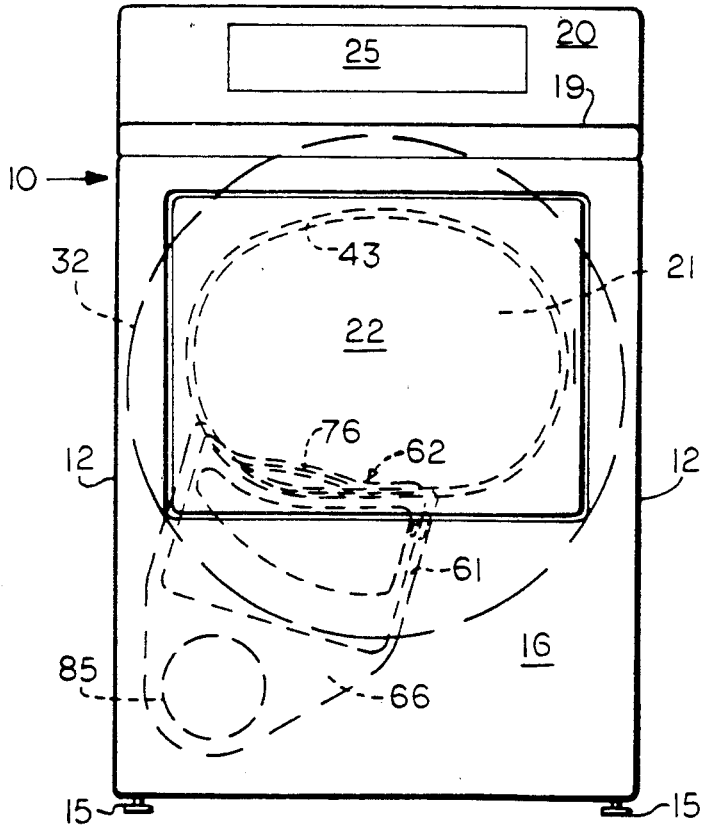
FIG. 1 is a front elevational view of a clothes dryer.
Figure 2:
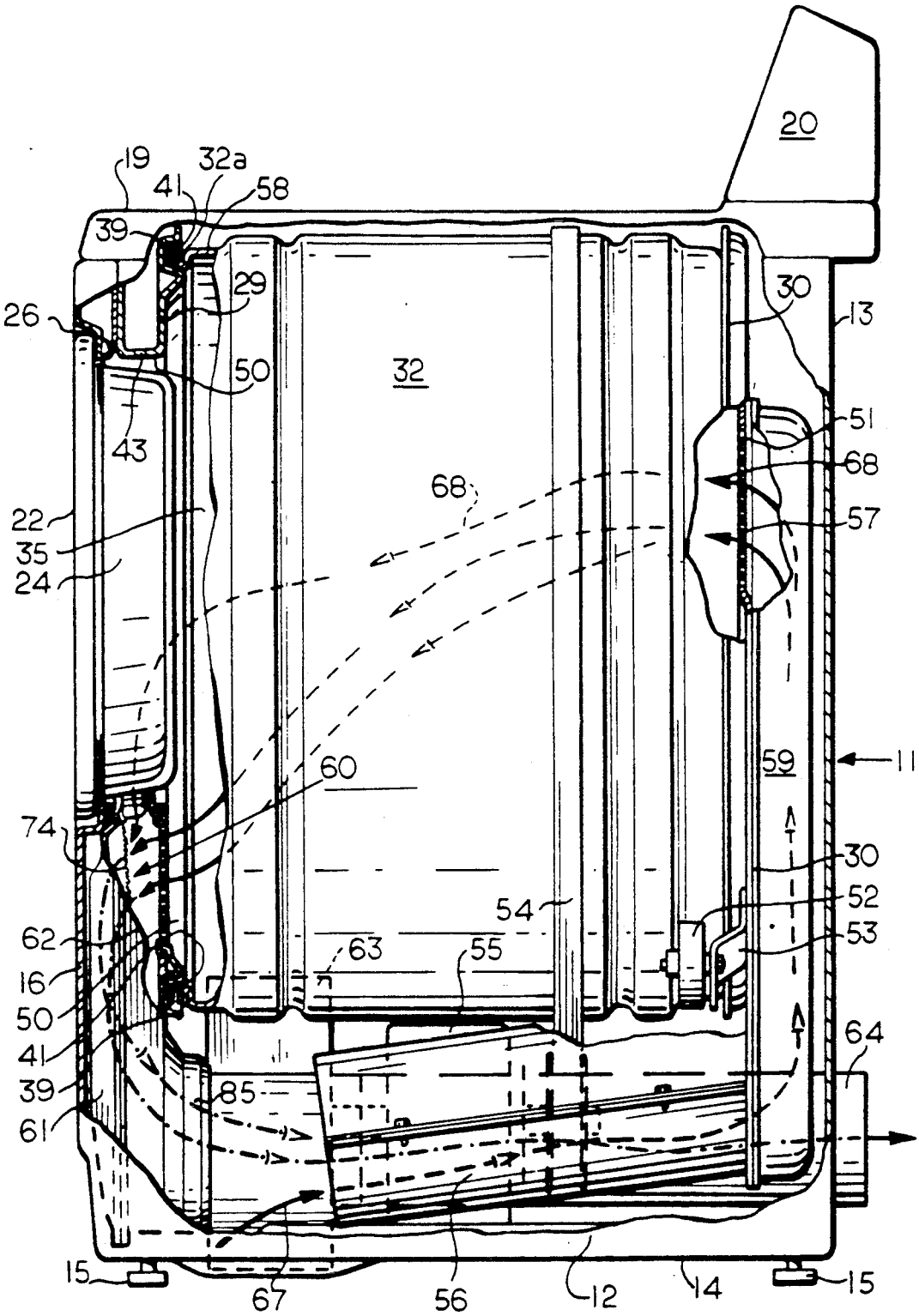
FIG. 2 is a side elevational view of the clothes dryer partially cut away and sectioned.

Referring to FIGS. 1 and 2 in particular, there is shown the overall construction of a fabric dryer 10 including a cabinet assembly comprising a side wall wrapper 11 having generally vertical opposite side panels 12 and a rear panel 13. The side wall wrapper 11 is supported on a base 14 which in turn is supported on a horizontal surface through a plurality of adjustable feet 15. The cabinet assembly further comprises a front panel 16 and a top cover 19 supported on the side wall wrapper 11. The top cover 19 includes an upwardly extending housing 20 for accommodating various controls for the fabric dryer 10.

The front panel 16 has a generally central access opening 21 and an access door 22 is hinged on the front panel 16 for operation between open and closed positions relative to the access opening 21. The door 22 includes an outer panel substantially flush with the front panel 16 and an inner panel or door liner 24 having a projecting portion that extends rearwardly through the access opening 21. A seal supported by the inner panel 24 extends around the rearwardly projecting portion of the inner panel 24 for engagement with a recessed portion 26 of the front panel adjacent the access opening 21 to effectively provide an air seal at the access opening 21.

Disposed within the cabinet assembly is a pair of spaced-apart generally vertical front and rear bulkheads 29 and 30. The rear bulkhead 30 is fixed to the side wall wrapper 11 by a pair of brackets connected to the rear panel 13. The front bulkhead 29 is similarly connected to the front flanges of the side panels 12.

A generally cylindrical peripheral side wall 32 is disposed for rotation between the stationary bulkheads 29 and 30. At the front and at the rear of the peripheral side wall 32 there are inwardly turned flanges **32*a* comprising relatively short end walls and juxtaposed the front and rear bulkheads 29 and 30 and cooperable with the peripheral side wall 32 and bulkheads 29 and 30 to effectively define a hollow drum providing a fabric drying chamber 35. A plurality of baffle members are fixed to the peripheral side wall 32 and extend radially into the drum for assisting in the movement of fabrics within the drying chamber 35 during rotation of the drum 32**.

The front and rear bulkheads 29 and 30 include generally annular recesses 39 facing the short end walls of the drum 32. Seals, such as at 41, are fixed to the bulkheads 29 and 30 in the recesses 39 and are engageable with the facing short inturned end walls of the drum 32 to provide an air seal at the ends of the fabric drying chamber 35.

Figure 3:
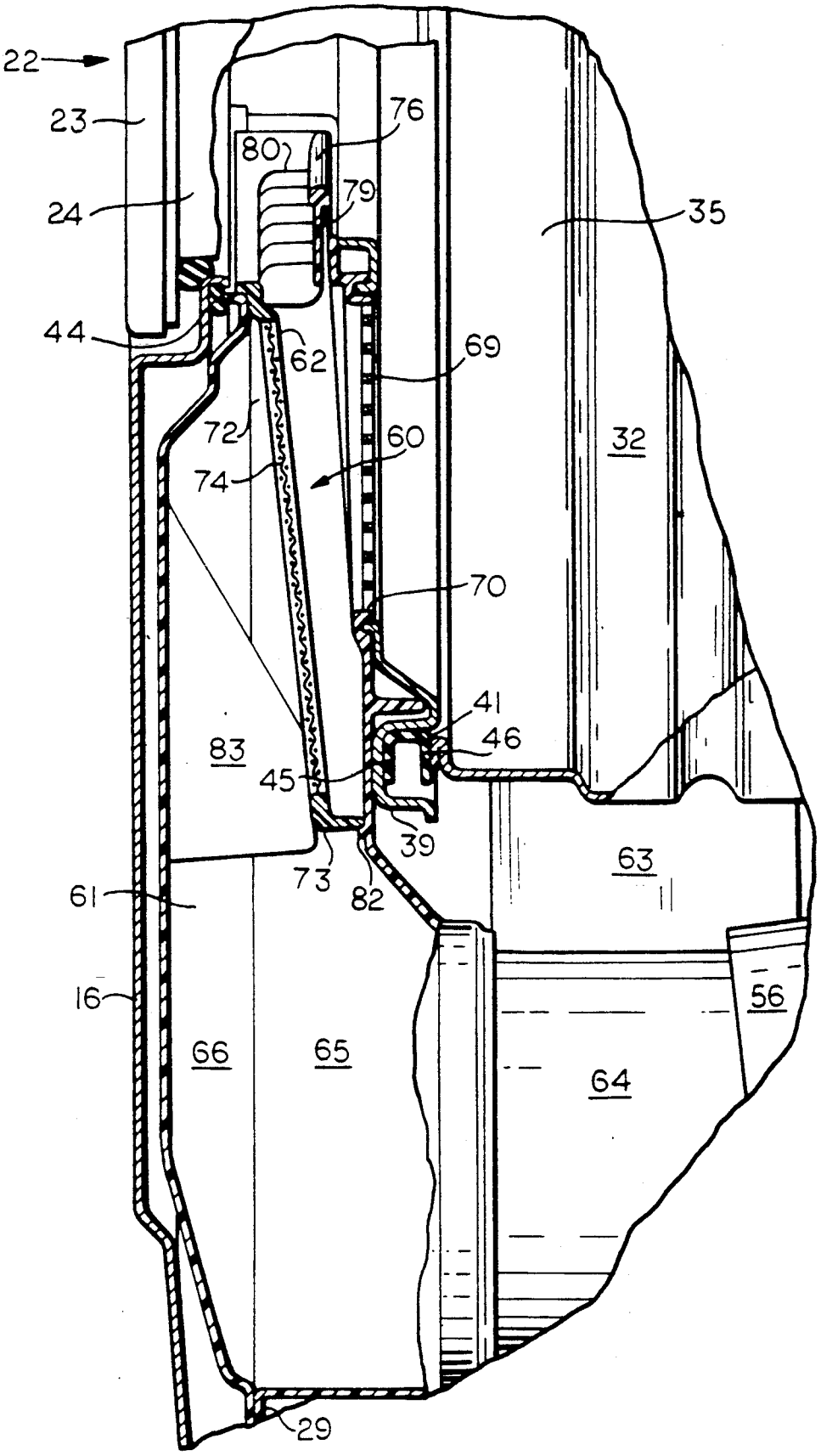
FIG. 3 is an enlarged portion of FIG. 2 showing the lint filter assembly in the clothes dryer of the present invention.
Figure 5:
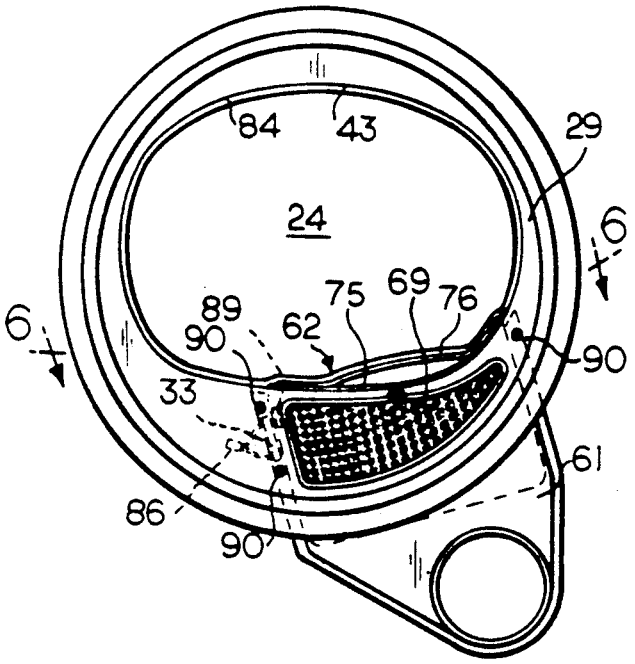
FIG. 5 is a partial elevation view of the clothes dryer and access opening as viewed from inside the drying chamber and showing the clothes drying chamber and the lint filter assembly in place.

FIGS. 2, 3 and 5 best show that the front bulkhead 29 includes a collar 43 that is forwardly extending as in FIG. 2, generally oval shaped as in FIG. 5 and is substantially axially aligned with the access opening 21 in the front panel 16. As best shown in FIG. 3, the collar 43 is sealed to the rear of the front panel 16 by gasket 44. The collar 43 thus is generally cooperable with the access opening 21 to form a tunnel-like passageway 50 extending horizontally between the front panel 16 and the drying chamber 35.

As further shown in FIG. 2, the rear bulkhead 30 includes an opening 51 for receiving a perforate panel 57 formed integrally with the air duct 59 and through which heated airflow is directed into the drying chamber 35.

The peripheral wall 32 of the drum is supported on a generally horizontal axis by a system including a pair of rollers 52 supported on brackets 53 fixed to the rear bulkhead 30 and by a pair of slide bearings (not shown) supported by brackets fixed to the front bulkhead 29 and engageable with annular surface 58. The peripheral drum wall 32 could be supported entirely on rollers or entirely on slides as conditions warrant.

Figure 2A:
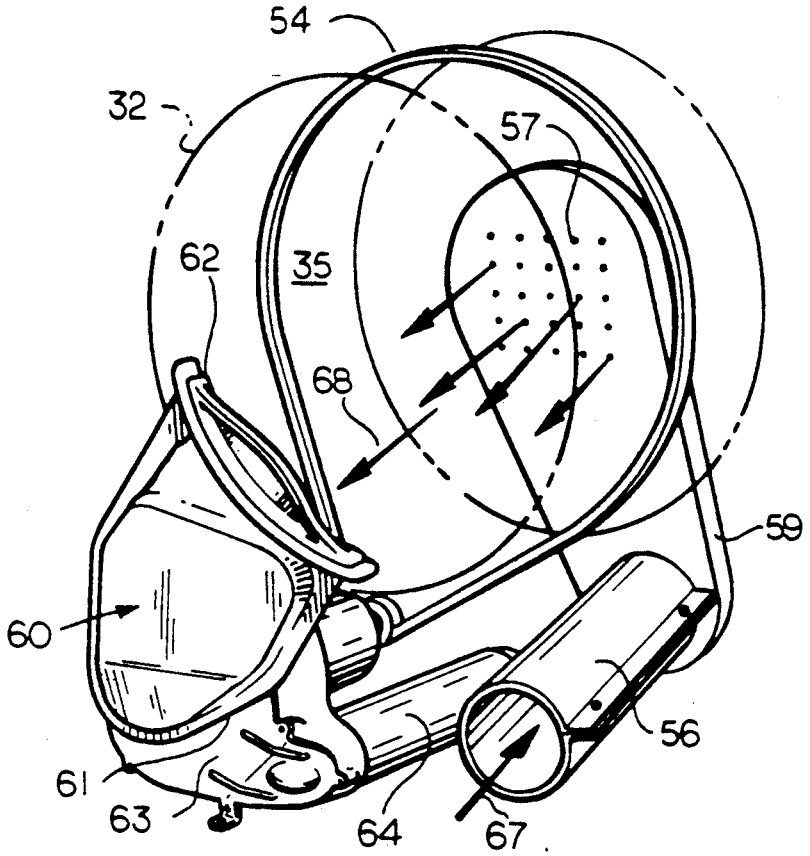
FIG. 2A is a front perspective view, partly schematic of the drying chamber and air system showing the lint filter in place.
Figure 2B:
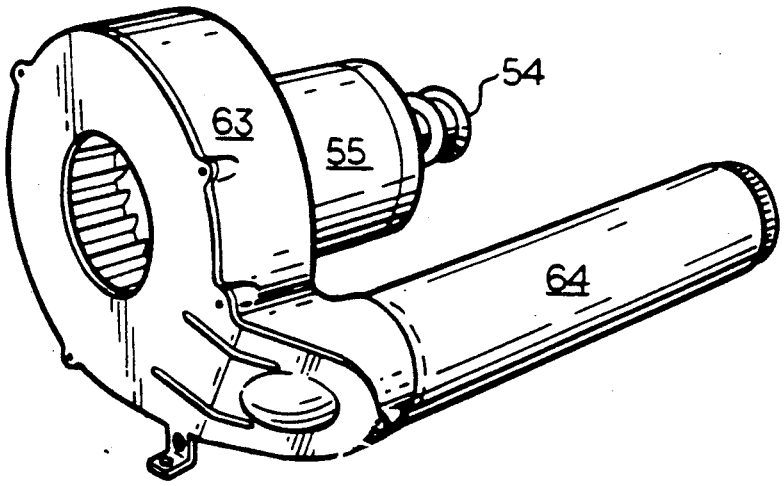
FIG. 2B is a partial view, in perspective, of the motor and blower for the dryer.

As further shown in FIGS. 2 and 2B, the peripheral drum wall 32 is rotated by a belt 54 encompassing the periphery thereof and driver by a motor 55 mounted on the base 14.

As best shown in FIGS. 2, 2A and 3, the airflow system for dryer 10 includes a heater housing 56 supported adjacent the base 14 and into which air is drawn from the immediate surroundings for heating prior to movement into the drying chamber 35. The heater housing 56 may accommodate either a gas or electric heating unit. The heater housing 56 is connected to a generally upwardly extending rear air duct 59 which conducts heated air from heater housing 56 through perforate panel 57 and into the drying chamber 35.

The heated air flows from the drying chamber 35 through a filter assembly 60 into the front air duct 61. The filter assembly 60 includes lint filter 62 disposed within front air duct 61 for removing lint particles from the air flowing out of the drying chamber 35 into the front air duct 61.

The air is drawn from the front air duct 61 into a blower assembly 63 from which it is forced through a rearwardly extending lower air duct 64 to atmosphere. The blower assembly 63 includes an impeller driven by the motor 55 mounted adjacent the blower assembly 63 on the base 14. The general airflow pattern within dryer 10 is shown by the line arrows 67 and 68. The line arrows 67 depict room temperature air being drawn into the heater housing 56, through the rear air duct 59 and into the drying chamber 35. The line arrows 68 show heated air passing through the drying chamber 35, into the filter assembly 60, through the filter 62, through the blower assembly 63 and through the lower air duct 64 to atmosphere.

Figure 4:
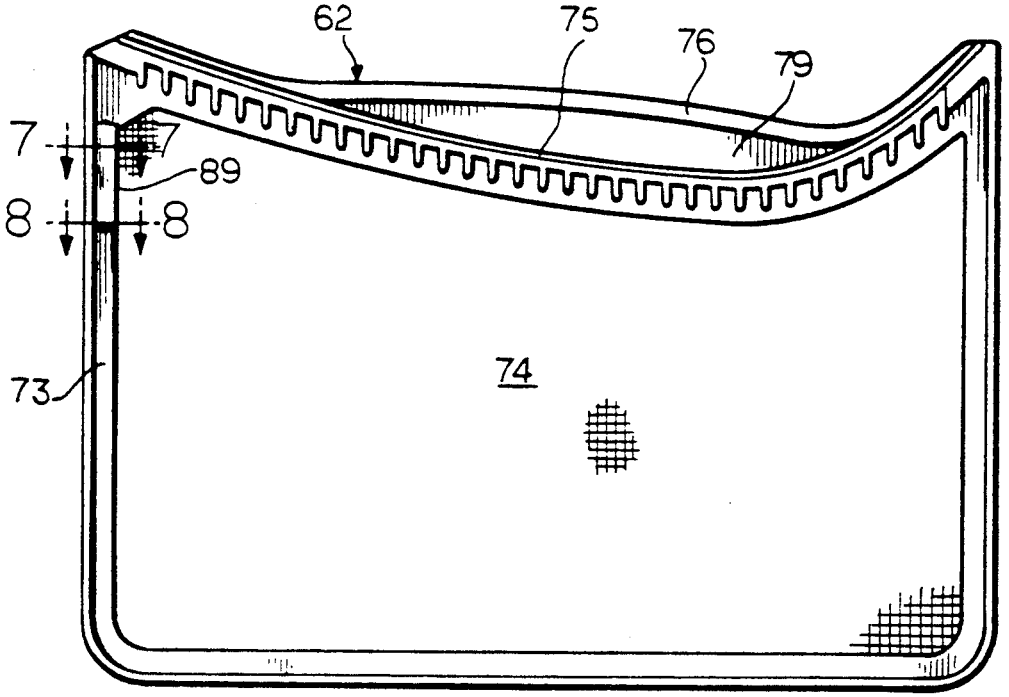
FIG. 4 is a front view of the lint filter screen of the lint filter assembly shown on FIG. 3.

Referring now to FIGS. 3–5 in particular, the lint filtering arrangement for the dryer 10 of FIG. 1 will be discussed in detail. In FIG. 5, the front air duct 61 is shown assembled to the front bulkhead 29 and the inner panel 24 of the door is shown in the door closed posture for closing the access opening.

As best shown in FIGS. 3 and 5, the front air duct 61 is a relatively thin, generally rectangular box-like structure. The front air duct 61 is molded from a plastic material as two halves which are joined to form a housing defining the front air duct 61. As test shown in FIG. 5, the first half of the front air duct 61 has a grid-like pattern of openings 69 oriented in a generally triangular arrangement and partially offset to the right of the vertical center line of the collar 43 formed in the front bulkhead 29. This grid-like pattern of openings 69 forms the primary airflow egress from the drying chamber 39 of the drum 32 into the front air duct 61. As further shown in FIGS. 3 and 5, the grid-like pattern of openings 69 are cooperable with a similarly shaped mating aperture 70 formed in the front bulkhead 29 when the front air duct 61 is attached thereto.

Figure 6:
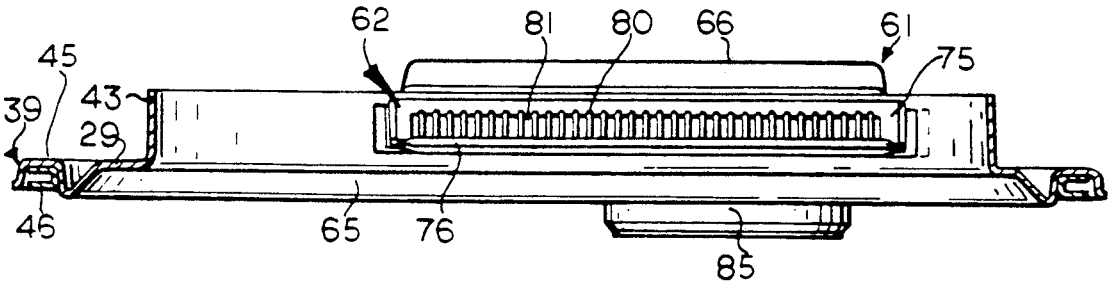
FIG. 6 is a sectional view taken along line 6—6 on FIG. 5.

The upper portion of the first and second halves of the front air duct 61 when assembled, substantially conform to the generally oval contour of the lower right side of the collar 43 as viewed from the perspective of FIGS. 5 and 6. That portion of the collar 43 is cut away to receive the front air duct 61. As indicated in FIG. 3, the front air duct 61 further includes a substantially rectangular top opening 72 for receiving the lint filter 62. The lint filter assembly will be further described herein.

Referring again to FIGS. 3–6, there is shown the lint filter 62 which is removably associated with the front air duct 61. The lint filter 62 is molded with a substantially rectangular frame 73 having a generally L-shaped cross section as best shown in FIG. 3. As further shown in FIG. 3, a section of filter screen 74 is directly molded into the frame 73.

The lint filter 62 also includes an upper flange 75 which conforms to the contour of the upper surface of the front air duct 61. The lint filter 62 extends downwardly through the rectangular opening 72 and the upper flange 75 is contoured so that it rests on the upper surface of the front air duct 61. A generally upstanding handle 76 is integrally molded into the top of the lint filter 62. The handle 76 extends upwardly and includes a substantially vertical wall portion 79 generally parallel with the vertical plane of the front bulkhead 29.

As best shown in FIGS. 3 and 6, &the lint filter 62 has a plurality of ribs 80 extending generally upwardly from the flange 75. The flange 75 is open between each rib 80 to define a plurality of apertures or ports 81 forming a secondary airflow egress from the chamber 35 into the front air duct 61.

FIG. 3 best shows the lint filter 62 located within the front air duct 61. The lint filter 62 extends downwardly through the opening 72 in the front air duct 61 and the lower portion of the frame 73 rests on a ledge 82 which extends across the first half 65 of the front air duct 61. The lint filter 62 is guided toward the ledge 82 by at least one downwardly sloping locating member 83 molded into the second half 66 of the front air duct 61.

In FIG. 5, the inner panel 24 of the door 22 is shown with the door 22 in the closed posture. The inner panel 24 and the collar 43 are spaced approximately ⅜ inch apart all around the periphery, in the preferred embodiment of the invention, to form a peripheral airflow space therebetween. Airflow is drawn into the airflow space and through the secondary airflow egress defined by the ribs 80 (FIG. 3). The lower right side of the inner panel 24 of the door is formed, as again shown in FIG. 5, to parallel the shape of the handle 76 of the lint filter 62. The inner panel 24 of the door 22 extends inwardly over the handle 76 and the secondary airflow egress so that the secondary airflow egress to the lint filter 62 is protected from blockage by tumbling articles of clothing.

In operation, heated air enters the drying chamber 35 through the rear air duct 59 and passes by and through articles of clothing to remove moisture therefrom. The moisture laden air enters the front air duct 61 by way of the primary and secondary airflow egresses located upstream from the lint filter 62. The air from both airflow egresses passes through the lint filter 62 to remove lint and other foreign particles and proceeds through the flanged outlet 85 of the front air duct 61 and is then exhausted to atmosphere through the lower air duct 64. The dual airflow egresses from the drying chamber 35 to the lint filter 62 ensure airflow through the clothes dryer 10 and help prevent cycling of the clothes dryer 10 on the high limit thermostat.

In the operation of the dryer 10, lint particles and the like are carried by the airflow from within the drying chamber 35 (see arrows 68 on FIG. 2) and are filtered onto the mesh surface of screen 74 of the lint filter 62. The most efficient and best operation of the clothes dryer 10 is dependent upon relatively unrestricted airflow through the egress passages through the lint filter 62. Failure to keep the lint filter 62 cleaned (periodically) may produce a mat of lint on the inner facing surface of screen 74 and restrict the airflow through the drying chamber 35.

The present invention provides a signal to remind the operator to clean the lint filter 62 which is accomplished by removing the lint filter 62 from its assembly. As alternates or in addition to providing a signal upon activating a new drying cycle, the signal could occur after a predetermined number of drying cycles or after a predetermined drying time. The clothes dryer 10 includes a display area 25 (FIGS. 1 and 10) associated with a microprocessor controller 23 that is mounted within the housing 20 on the top rear surface of the clothes dryer 10. The display area 25 faces forward on the housing 20 and is framed within a cutout that supports it within the housing 20.

Figure 9:
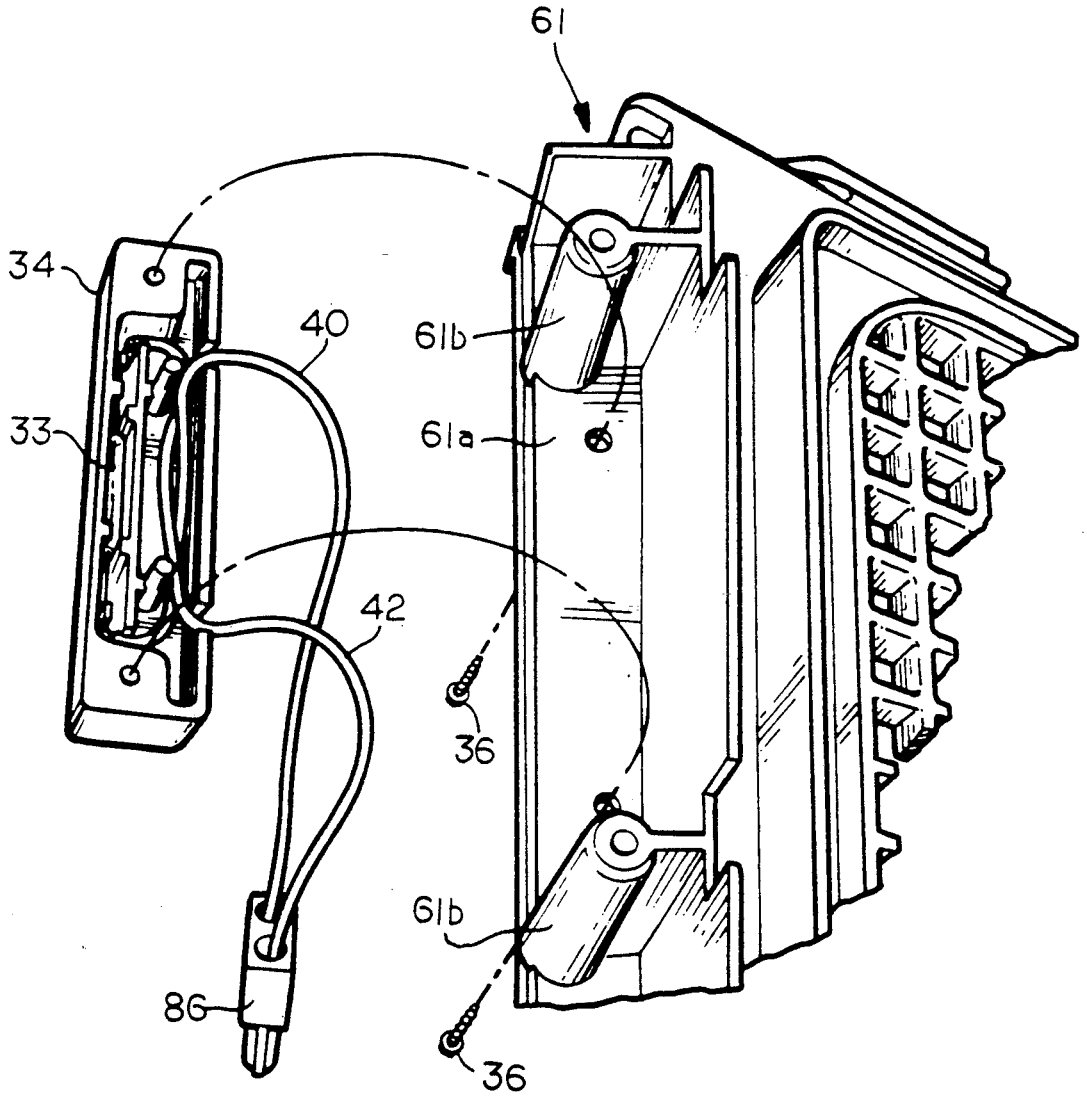
FIG. 9 is a spacial view in perspective showing the reed switch and its electrical leads and the mounting thereof on the lint filter assembly of the clothes dryer.

As is seen on FIG. 9, a lint filter reed switch 33 is retained within a plastic housing 34 that is fastened by screws 36 onto the inner side of the flange 61*a* of air duct 61. The reed switch 33 is an Amperex Electronic Corporation part number RI-23-MT. Depending from the flange 61*a* are spaced apart bosses 61*b* which attach the air duct 61 by the screws 90 (see FIG. 5) onto the front bulkhead 29. Reed switch 33 includes low voltage electrical leads 40 and 42 that are held at their outer ends in a male receptacle connector 86. From the mating connector extend a pair of electrical leads which connect to the circuit board of FIG. 12 and correspond to points CC11 and CC12 in FIG. 12. In this manner, reed switch 33 is electrically connected to the microprocessor 23 (FIG. 12) and is fixed along the slide passage provided adjacent flange 61*a* for the lint filter 62 in which the latter is supported in the air duct 61.

Figure 7:
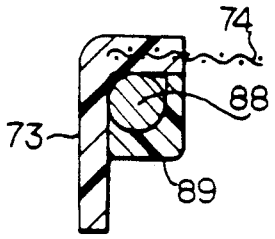
FIG. 7 is a sectional view taken along line 7—7 on FIG. 4.
Figure 8:
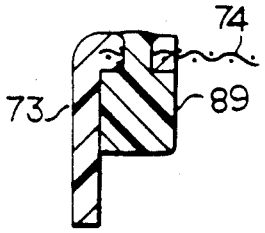
FIG. 8 is a sectional view taken along line 8—8 on FIG. 4.

Referring to FIGS. 4, 7 and 8, an elongated magnet 88 is enclosed in a plastic holder 89. The holder 89 is adhesively or otherwise secured to the side flange of frame 73 in a location that will place the elongated magnet 88 opposite reed switch 33 when the lint filter 62 is in its operating position. The reed switch 33 is operated by movement of the magnet 88 relative to the switch. The reed switch 33 impresses a signal on the microprocessor 23 by the changing open and closed postures of the switch contacts whenever the lint filter 62 with magnet 88 is removed from and replaced into the outlet duct 61. Removing and replacing the lint filter 62 will terminate or prohibit the CHECK FILTER signal for the present time. Simply removing the lint filter 62 without replacement will activate the signal. It is anticipated that, alternatively, a mechanical switch could be utilized rather than a reed switch system where removal of the lint filter 62 would also cause a change in the posture of the switch.

Figure 11:
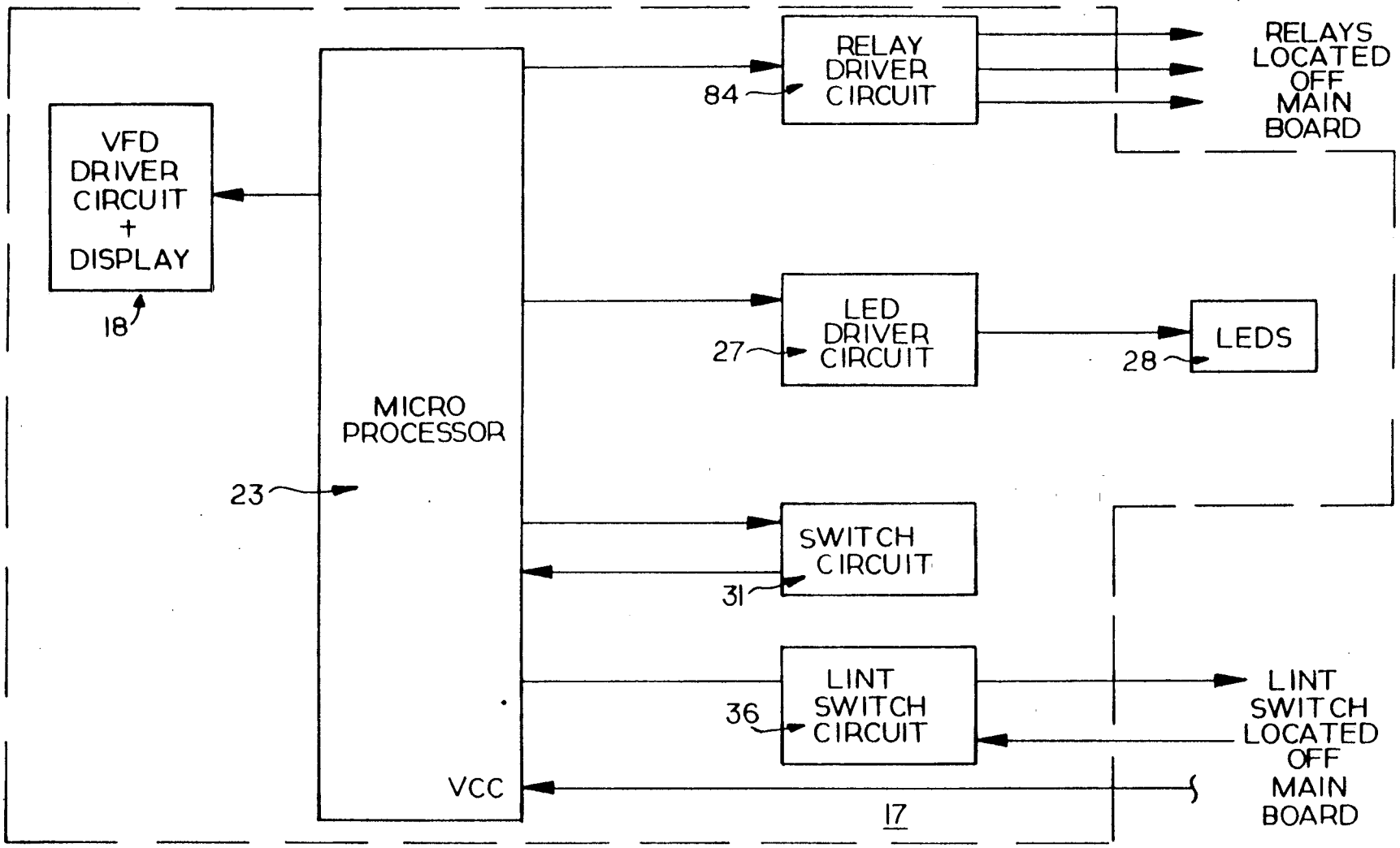
FIG. 11 is a block diagram of an electrical circuit for the clothes dryer.
Figure 12:
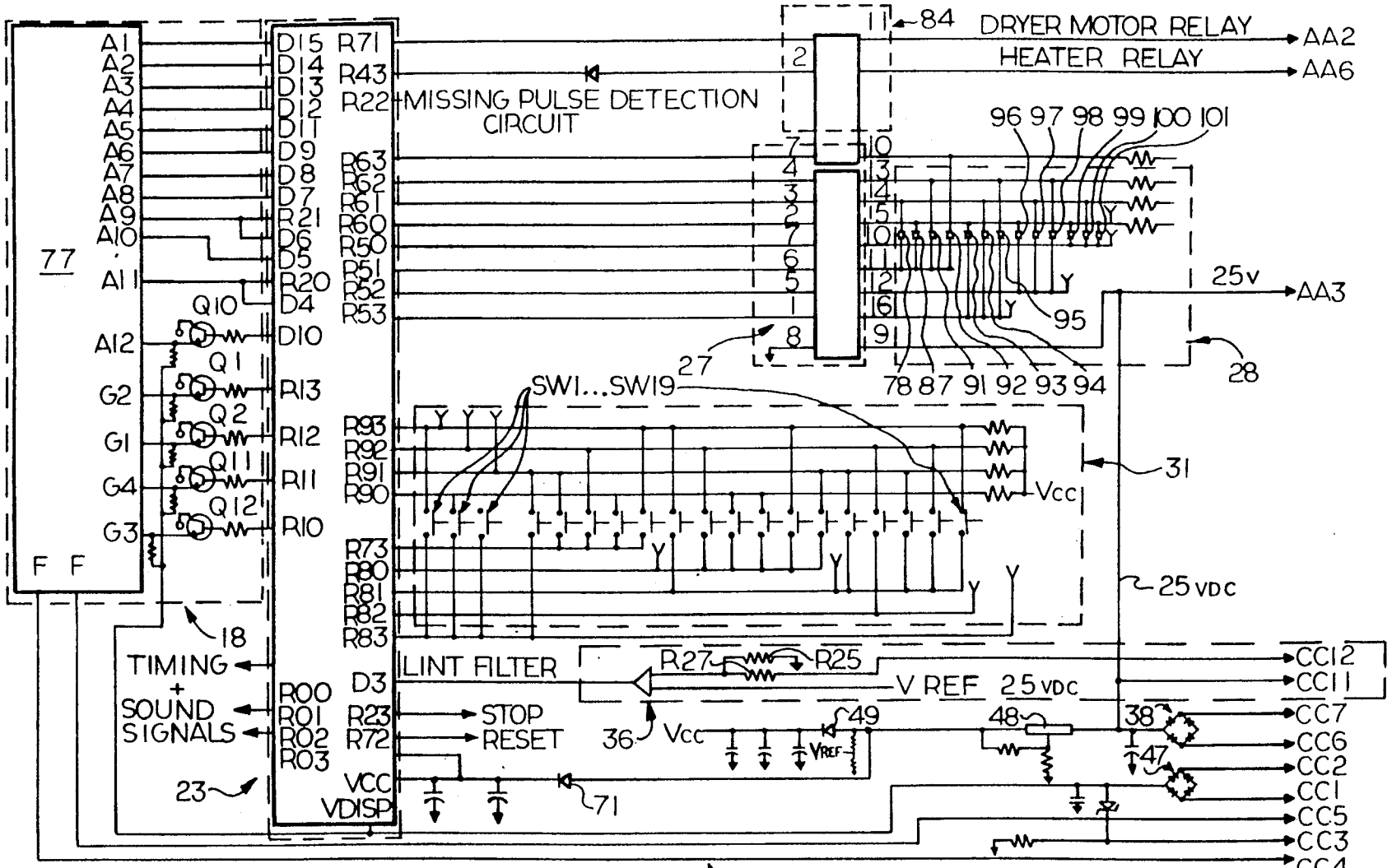
FIG. 12 is an electrical circuit diagram of the main circuit board of the clothes dryer including electrical elements of the block diagram of FIG. 11.

Referring now to FIG. 11, there is shown a block diagram of an electrical circuit for the clothes dryer 10. Only blocks that are related to the present invention are shown. In no way does FIG. 11 show every element for a clothes dryer 10, but the elements not shown are well known in the art. FIG. 12 illustrates a main circuit board 17 which contains vacuum fluorescent display driver circuit and display 18, microprocessor. 23, relay driver circuit 84, light emitting diode (LED) driver circuit 27, LEDs 28, switch circuit 31 and lint switch circuit 36. Microprocessor 23, in the preferred embodiment, is a Hitachi part number HMCS 404C and communicates with controls relays (not shown) through relay driver circuit 84; LEDs 28 through LED driver circuit 27, switch circuit 31, lint switch circuit 36 and vacuum fluorescent display dryer circuit and display 18. The basic operation of the circuit is well known in the art and need not be described in detail to provide full disclosure.

Figure 13:
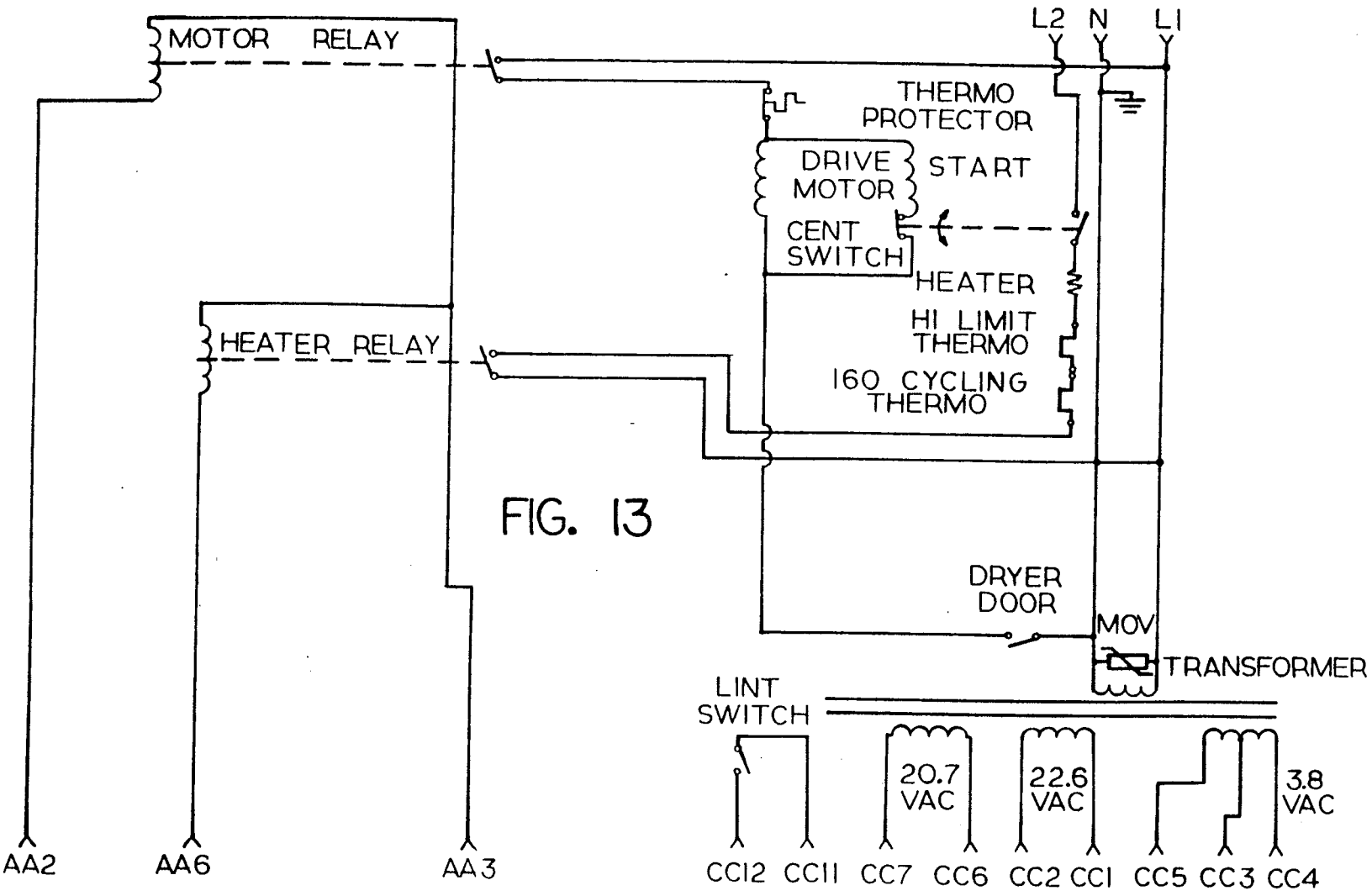
FIG. 13 is an electrical schematic diagram of the clothes dryer components located away from the main circuit board of FIG. 12.

FIG. 13 is an electrical schematic of the main clothes dryer components located away from the board 17 shown in FIG. 12. The blocks in FIG. 11 have been shown in FIG. 12 as dashed lines enclosing the portions of the main circuit board 17 represented by the boxes of FIG. 11.

To begin with, a brief description of the main board 17 power supply will be given. A 25 VDC power supply is obtained from well known means. Specifically, as shown in FIG. 13, a 120 VAC input is connected across a metal oxide varistor (MOV) and the primary winding of a step-down transformer having a first secondary winding producing 20.7 VAC, a second secondary winding producing 3.8 VAC and a third secondary winding producing 22.6 VAC. The 20.7 VAC is applied across a full-wave bridge circuit 38 (FIG. 12) producing 25 VDC and the 22.6 VAC is applied across a fullwave bridge circuit 47 producing −30 VDC.

The 25 VDC power supply is applied to the input of voltage regulator 48, light emitting diodes (LEDs) and system relays (not shown). The −30 VDC provides power for the vacuum fluorescent display driver circuit and display 18.

The 25 VDC as input to voltage regulator 48 provides 5.7 VDC at its output. The 5.7 VDC passes through diode 49 and drops to 5 volts therein. Diode 71 is a companion to diode 49 that ensures a $V_{cc}$ of 5 VDC through the main board.

Vacuum fluorescent display (VFD) 77 is constructed for multiplexing with 4 grids, each grid controlling up to 12 segments. Each grid is multiplexed at a frequency of 64 hertz/second and has ⅛ duty cycle. In this embodiment, VFD 77 is a Futaba, model 2-MT-19G S-3822G. Grid G3, G4, G1, G2 and segment A12 are controlled by microprocessor 23 pins R10–13 and D10, respectively. Transistors Q12, Q11, Q1, Q2 and Q10 are used to provide additional power to the grids and segment A12. The remaining segments A1–A11 are driven directly by microprocessor 23.

Switch circuit 31 contains touch switches SW1–SW19. Switches SW1–SW19 may be any common switch available such as Omron B3W-1002 or ALPS SKHWAD. Switches SW1–SW19 together with VFD 77 provide an interacting, interfacing between the appliance, specifically the dryer, and the user.

Relay driver circuit 84 (FIG. 11) consists of a transistor array (not shown) which provides power and control to 1 LED drive and 2 relay drives.

LED driver circuit 27 includes a transistor array (not shown) which serves to provide power and control for LEDs. Thirteen LEDs, 78, 87, 91, 92, 93, 94, 95, 96, 97, 98, 99, 100 and 101, shown on FIG. 12, are wired for a 4×4 multiplexing with a frequency of 64 hertz/second and a ⅛ duty cycle. Power for the operation and control of the LEDs is obtained from both relay driver circuit 84 and LED driver circuit 27.

Lint switch circuit 36 provides means for sensing the status of the lint filter reed switch 33 in the clothes dryer 10. The lint switch circuit 36 is a circuit composed of an operational amplifier, resistors R25 and R27 and the lint filter reed switch 33.

The lint switch circuit 36 operates in the following manner to allow the microprocessor 23 to monitor the status of the lint filter reed switch 33. The voltage level at point CC12 will be 0 volts if the lint filter reed switch 33 is open and 25 VDC if the lint filter reed switch 33 is closed. The 25 VDC power to the lint filter reed switch 33 is supplied from the circuit board at point C11. Resistors R25 and R27 reduce the voltage levels to 0 volts if the lint filter reed switch 33 is open and to about 5 VDC if the lint filter reed switch 33 is closed. The reference voltage is held at 2.5 VDC. The operational amplifier compares the voltage level from the lint filter reed switch 33 with the 2.5 VDC reference voltage. The operational amplifier outputs 0 volts to input D3 of the microprocessor 23 if the lint filter reed switch 33 voltage is greater than 2.5 VDC and outputs about 3.5 VDC if the reference voltage is greater than the voltage at the lint filter reed switch 33. The microprocessor 23 can thus sense the status of the lint filter reed switch 33 from the signal read at its D3 input. A 3.5 % VDC input corresponds to a closed lint filter reed switch 33 and a 0 volt input corresponds to an open lint filter reed switch 33. The microprocessor 23 will effect the display of CHECK FILTER based on the sensed status of the lint filter reed switch 33.

Figure 10:
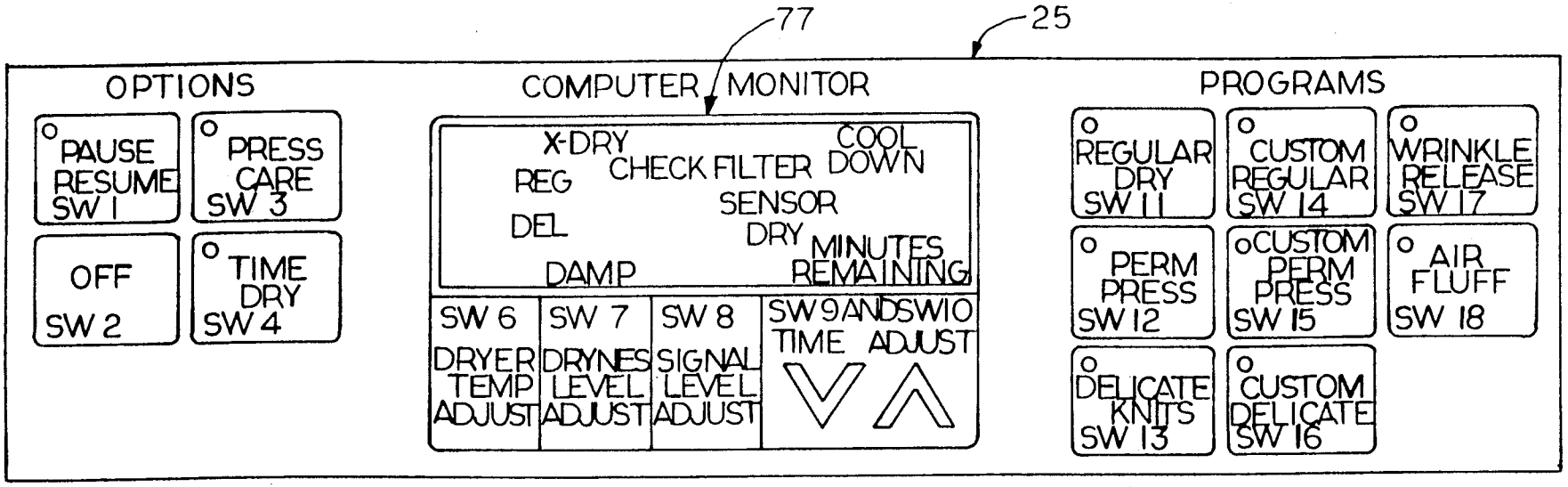
FIG. 10 is a front elevational view of the display panel area for the clothes dryer.

After the lint filter 62 is removed for inspection and cleaning, if necessary, it is reinserted in the air duct 61. This places the magnet 88 at its location adjacent the reed switch 33, which in turn resets the reed switch 33 for another cycle to input the microprocessor 23. As the reed switch 33 is reset, in a manner as was just described, the microprocessor 23 determines this posture of the switch 33 and turns off the CHECK FILTER display. In short, the microprocessor 23 must obtain an input of a complete cycle of the reed switch 33 to remove the CHECK FILTER from display area of display 77 (FIG. 10).

A clean lint filter 62 enables the user to save drying time and cost of operating the dryer by reason of efficient operation. This invention provides the user with a reminder to keep the lint filter clean. To do so ensures proper machine maintenance of the dryer. The system used in the invention, as is described herein, does not fault the cycle and is not a condition of the cycle to continue with drying. It assumes that once the cool-down portion of the cycle has been achieved and the dryer door is opened, the filter should be removed and inspected. The microprocessor must see that the switch cycle between open and closed postures has been accomplished to remove the display area CHECK FILTER signal. The switch is cycled only by removing and replacing the lint filter.

In the drawings and specification, there has been set forth a preferred embodiment of the invention and best mode thereof. The specific terms employed in the specification are used in a generic and descriptive sense and are not intended for purposes of limitation. Changes in the form and proportion of parts, as well as the substitution of equivalents, are contemplated as circumstances may suggest or render expedient without departing from the spirit or scope of the invention as is defined in the following claims.

It is claimed:

1. A clothes dryer comprising:

a clothes drying chamber, means for supplying heated air into said drying chamber and circulating said air therein, means for removal of the circulated air from said drying chamber, said means including a lint filter assembly and outlet air duct, said lint filter assembly including a lint filter element, a stationary support in said outlet air duct for removably supporting said lint filter element, a switch means mounted on said stationary support in the proximity of said lint filter element supported therein, an activator for said switch means carried on said lint filter element, a user recognizable signal means in circuit with said switch means and under control of said switch means, said signal means providing a signal to the user to check the condition of said lint filter element, said user recognizable signal means being inactivated upon removal of said lint filter element from said stationary support and reengagement with said stationary support.

2. The clothes dryer of claim 1 in which said switch means comprises a magnetically operated switch fastened on said stationary support for said lint filter element and wherein said activator comprises a magnetic actuator element fastened to said lint filter element for placement in the proximity of said magnetically operated switch when said lint filter element is held in said stationary support.

3. The clothes dryer of claim 2 wherein said magnetically operated switch is a reed switch and said magnetic actuator element is a magnet.

4. A clothes dryer comprising:

a clothes drying chamber, means for supplying heated air into said drying chamber and circulating said air therein, an air duct member connected into said drying chamber for exhausting air therefrom, said air duct member comprising a lint filter assembly including a removable lint filter element disposed across said air duct member for filtering loose particles from the air exhausted from said drying chamber.

a microprocessor for controlling the operation of said clothes dryer, a display unit operatively associated with said microprocessor for providing a user recognizable signal for the user to check the condition of said lint filter element prior to operation of said clothes dryer, said display unit being controlled by said microprocessor, a lint switch having open and closed postures and fastened on said air duct member, a switch operated connected to said lint filter element, the movement of said lint filter element in removal from said lint filter assembly and replacement in said lint filter assembly each changing the posture of said lint switch, said lint switch being in a circuit for impressing an electrical signal on said microprocessor responsive to removal and replacement of said lint filter element in said lint filter assembly, said microprocessor effecting the display of said user recognizable signal on said display unit for the user to check condition of said lint filter element based upon the sensed status of the change in posture of said lint switch.

5. The clothes dryer of claim 4 wherein said display unit comprises a vacuum fluorescent display panel.

6. The clothes dryer of claim 5 in which said display panel displays a CHECK FILTER signal when the posture of said lint switch is unchanged after completion of a drying cycle.

7. The clothes dryer of claim 4 in which said lint switch comprises a reed switch that is magnetically operated, said reed switch being fastened on said air duct member and said switch operator comprising a magnet fastened on said lint filter element.

8. The clothes dryer of claim 7 wherein said lint filter element comprises a plastic frame encircling and holding a porous filter screen, said magnet being fastened on said plastic frame.

9. The clothes dryer of claim 8 wherein said lint filter element is held in said lint filter assembly in operating position for filtering the air moving through said air duct such that said reed switch and said magnet are placed in juxtaposition.

10. A clothes dryer comprising a clothes drying chamber, means for supplying heated air into said drying chamber and circulating said air therein, air duct means connected to said drying chamber for exhausting air therefrom and including a lint filter assembly having a removable lint filter element disposed for filtering lint particles from said exhausted air, program means having a memory and operable for controlling said clothes dryer through at least one predetermined drying cycle, display means operatively associated with said program means and controlled thereby for signaling the user to check the condition of said lint filter element prior to starting said drying cycle, switch means mounted on said air duct means and operable between open and closed postures responsive to the removal and replacement of said lint filter element in said air ducts means, said switch means being in circuit association with said program means and with said display means for signaling said memory when the posture of said switch means changes in response to removal and replacement of said lint filter element, said program means effecting the display of a visual signal in said display means if said lint filter element has not been removed since completion of the last cycle.

11. A method of signaling the user of a clothes dryer to check the condition of a removable filter element disposed in filtering position in the path of air flow from the dryer comprising the steps of displaying a visual signal to check said filter element;

providing a switch on the dryer adjacent said filter element at its filtering position, the setting of said switch being changed upon (a) the removal of said filter element and (b) reinsertion of said filter element to its said filtering position, and terminating said signal by changing the setting of said switch.

12. The method of claim 11 in which said switch is magnetically operated, said filter element being provided with a magnet for operating said switch in response to proximity of said magnet thereto.

13. The method of claim 11 in which said switch is a reed switch operated by a magnet carried on said filter element.

14. In a clothes dryer having a drying chamber supplied with heated air and exhausting air therefrom, the exhausted air passing through a filter assembly having a lint filter to entrap foreign particles, said lint filter being removable from said filter assembly for cleaning and replacing same for filtering operation, the method of signaling the user to check the condition of said lint filter prior to initiating clothes drying operations comprising the steps of providing a switch in said filter assembly that is operated, respectively, by the removal and replacement of said lint filter, sensing the posture of said switch before the dryer operation is initiated, displaying a signal for the user to check said lint filter prior to dryer operation dependent upon operation of said switch since last use of said dryer, removing and replacing said lint filter to its filtering position to remove the display of said signal.

15. The method of claim 14 in which said signal is displayed on a vacuum fluorescent display panel on said dryer.

16. The method of claim 15 in which said dryer is controlled by a microprocessor which senses that said switch has been operated through a cycle by removing and replacing said lint filter to effect the display of said signal for the user to check the condition of said lint filter.

17. The method of claim 16 in which said switch impresses a different signal on the microprocessor depending upon the position of said switch, for effecting the user display to check said lint filter.

* * * * *